US009281640B2

(12) United States Patent
Kondo et al.

(10) Patent No.: US 9,281,640 B2
(45) Date of Patent: Mar. 8, 2016

(54) CONNECTOR

(71) Applicant: FUJITSU COMPONENT LIMITED, Tokyo (JP)

(72) Inventors: Takahiro Kondo, Tokyo (JP); Koki Sato, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/692,835

(22) Filed: Apr. 22, 2015

(65) Prior Publication Data

US 2015/0311651 A1 Oct. 29, 2015

(30) Foreign Application Priority Data

Apr. 24, 2014 (JP) ..... 2014-090557

(51) Int. Cl.

| | |
|---|---|
| ***H01R 9/05*** | (2006.01) |
| ***H01R 24/40*** | (2011.01) |
| ***H01R 13/24*** | (2006.01) |
| *H01R 12/71* | (2011.01) |
| *H01R 13/6474* | (2011.01) |
| *H01R 103/00* | (2006.01) |

(52) U.S. Cl.
CPC ..... *H01R 24/40* (2013.01); *H01R 13/2428* (2013.01); *H01R 12/714* (2013.01); *H01R 13/6474* (2013.01); *H01R 2103/00* (2013.01)

(58) Field of Classification Search
CPC ..... H01R 23/7068; H01R 2103/00
USPC ..... 439/59, 63, 578, 580, 581, 944
See application file for complete search history.

(56) References Cited

U.S. PATENT DOCUMENTS

| | | | | | |
|---|---|---|---|---|---|
| 6,045,402 | A * | 4/2000 | Embo | H01R 24/50 | 439/561 |
| 6,065,976 | A | 5/2000 | Wang | | |
| 6,132,244 | A * | 10/2000 | Leeman | H01R 23/688 | 439/541.5 |
| 6,152,743 | A * | 11/2000 | Fox | H01R 24/42 | 439/620.03 |
| 7,150,648 | B1 * | 12/2006 | Hall | H01R 24/50 | 439/581 |
| 7,186,138 | B2 * | 3/2007 | Wang | H01R 13/73 | 439/541.5 |
| 7,234,967 | B2 * | 6/2007 | Weidner | H01R 9/0515 | 439/581 |

(Continued)

FOREIGN PATENT DOCUMENTS

| | | |
|---|---|---|
| JP | S60-158357 | 8/1985 |
| JP | H05-121124 | 5/1993 |

(Continued)

*Primary Examiner* — Thanh Tam Le
(74) *Attorney, Agent, or Firm* — IPUSA, PLLC

(57) ABSTRACT

A connector includes a ground pin and a signal pin. The ground pin includes a first cylindrical part, a first cylindrical terminal telescopically movable into the first cylindrical part, and a first elastic member compressible in a first central axis direction. The signal pin includes a second cylindrical part, a second cylindrical terminal telescopically movable into the second cylindrical part, and a second elastic member compressible in a second central axis direction. The signal pin is provided concentrically with the first elastic member and the first cylindrical part, and has a one-piece structure of a single metal plate. The first and the second cylindrical parts are connected to a ground line and a signal line of a board with the first and second cylindrical terminals being in contact with the board and compressed in the first and second central axis directions, respectively.

5 Claims, 9 Drawing Sheets

(56) References Cited

U.S. PATENT DOCUMENTS

| | | | | |
|---|---|---|---|---|
| 7,326,063 | B1 * | 2/2008 | Raudenbush | H01R 4/64 439/581 |
| 7,500,855 | B2 * | 3/2009 | Kari | H01R 24/50 439/63 |
| 7,946,853 | B2 | 5/2011 | Breinlinger et al. | |
| 8,506,306 | B2 * | 8/2013 | Liu | H01R 12/7052 439/63 |
| 9,004,924 | B2 * | 4/2015 | Kuo | H01R 13/6205 439/188 |
| 2008/0102654 | A1 * | 5/2008 | Kari | H01R 24/50 439/63 |
| 2010/0261356 | A1 * | 10/2010 | Morley | H01R 13/46 439/63 |
| 2012/0329298 | A1 * | 12/2012 | Hardy | H01R 24/50 439/78 |

FOREIGN PATENT DOCUMENTS

| | | |
|---|---|---|
| JP | 2008-545242 | 12/2008 |
| JP | 2013-205191 | 10/2013 |
| WO | 2008/120856 | 10/2008 |

* cited by examiner

FIG.4A
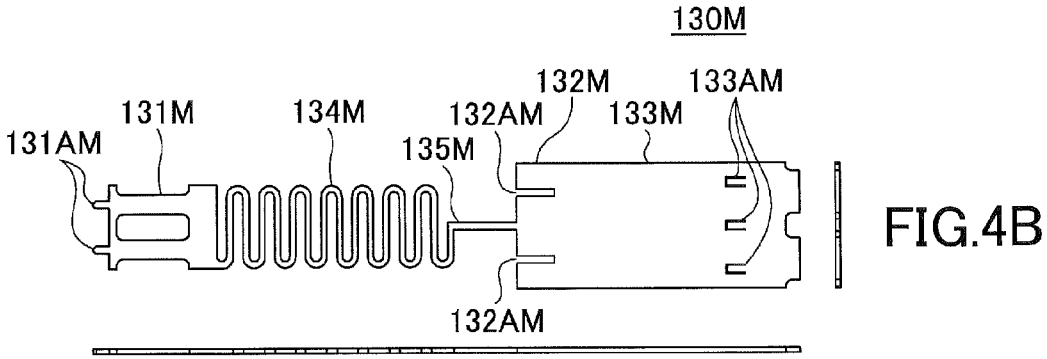
FIG.4B
FIG.4C
FIG.5A
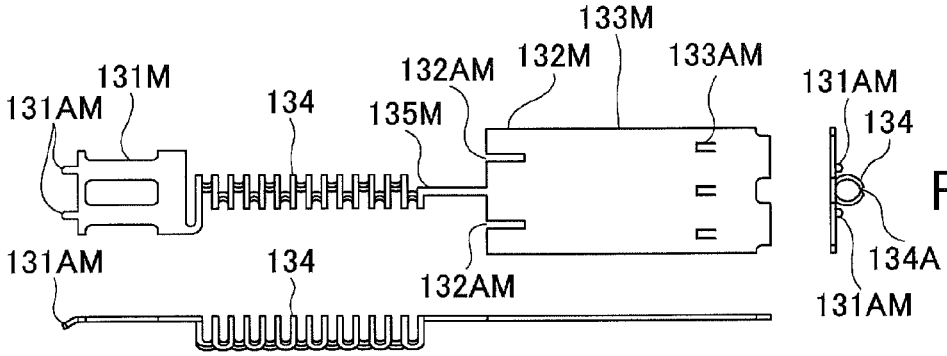
FIG.5B
FIG.5C

FIG.6A
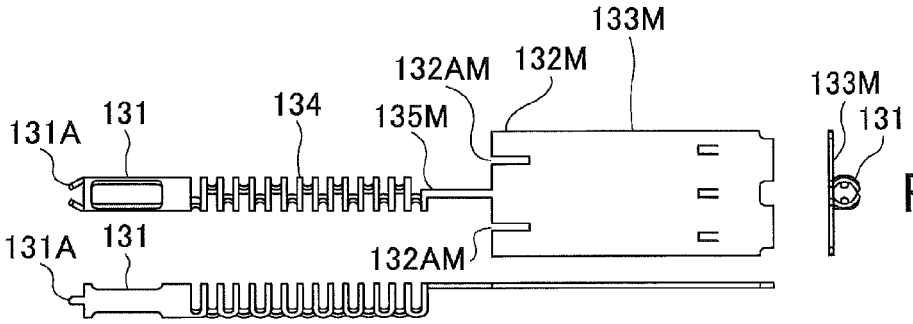
FIG.6B
FIG.6C
FIG.7A
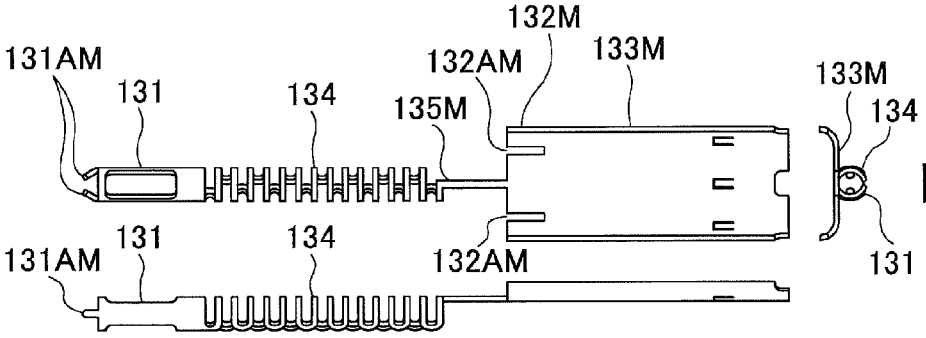
FIG.7B
FIG.7C

FIG.8A
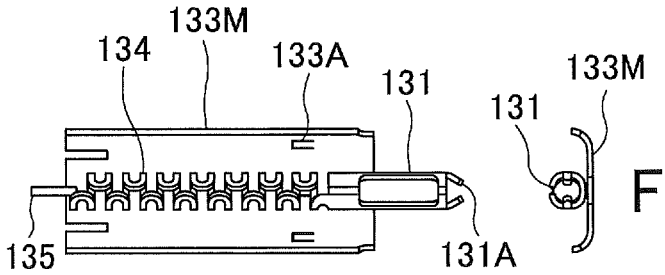
FIG.8B
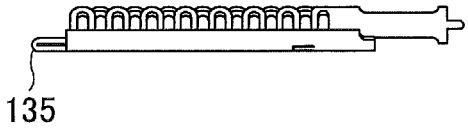
FIG.8C
FIG.9A
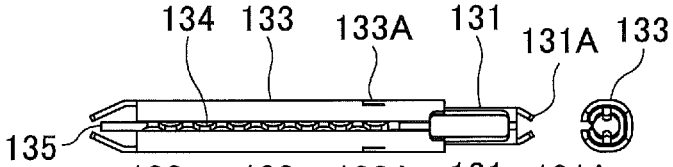
FIG.9B
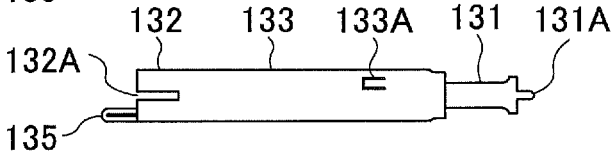
FIG.9C

CONNECTOR

CROSS-REFERENCE TO RELATED APPLICATION

The present application is based upon and claims the benefit of priority of Japanese Patent Application No. 2014-090557, filed on Apr. 24, 2014, the entire contents of which are incorporated herein by reference.

BACKGROUND OF THE INVENTION

1. Field of the Invention

The present invention relates to connectors.

2. Description of the Related Art

For example, Japanese National Publication of International Patent Application No. 2008-545242 illustrates a compliant contactor that includes a center conductor and an outer conductor with a spacer therebetween. The outer conductor has a mating end adapted to be capable of flexibly contacting an outer conductor mating surface before the center conductor contacts a center conductor mating surface.

SUMMARY OF THE INVENTION

According to an aspect of the present invention, a connector includes a ground pin and a signal pin. The ground pin includes a first cylindrical part, a first cylindrical terminal telescopically movable into the first cylindrical part, and a first elastic member compressible in a first central axis direction. The signal pin includes a second cylindrical part, a second cylindrical terminal telescopically movable into the second cylindrical part, and a second elastic member compressible in a second central axis direction. The signal pin is provided concentrically with the first elastic member and the first cylindrical part, and has a one-piece structure of a single metal plate. The first and the second cylindrical parts are connected to a ground line and a signal line of a board with the first and second cylindrical terminals being in contact with the board and compressed in the first and second central axis directions, respectively.

BRIEF DESCRIPTION OF THE DRAWINGS

FIGS. 4A through 4C are diagrams illustrating the method of manufacturing a signal pin according to the first embodiment;

FIGS. 5A through 5C are diagrams illustrating the method of manufacturing a signal pin according to the first embodiment;

FIGS. 6A through 6C are diagrams illustrating the method of manufacturing a signal pin according to the first embodiment;

FIGS. 7A through 7C are diagrams illustrating the method of manufacturing a signal pin according to the first embodiment;

FIGS. 8A through 8C are diagrams illustrating the method of manufacturing a signal pin according to the first embodiment;

FIGS. 9A through 9C are diagrams illustrating the method of manufacturing a signal pin according to the first embodiment;

DESCRIPTION OF THE EMBODIMENTS

Embodiments to which a connector according to an aspect of the present invention is applied are described below.

First Embodiment

Figure 1A:
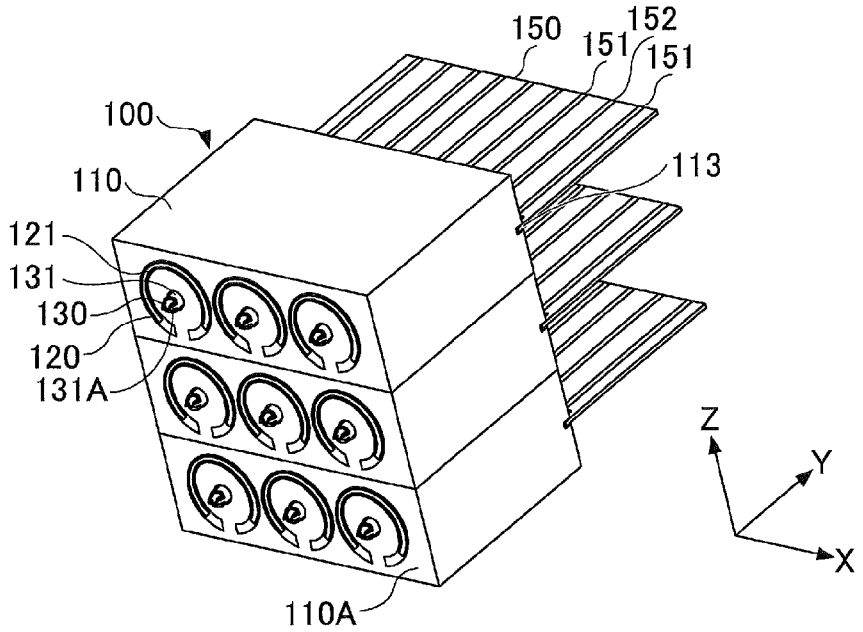
FIGS. 1A and 1B are diagrams illustrating a connector according to a first embodiment.
Figure 1B:
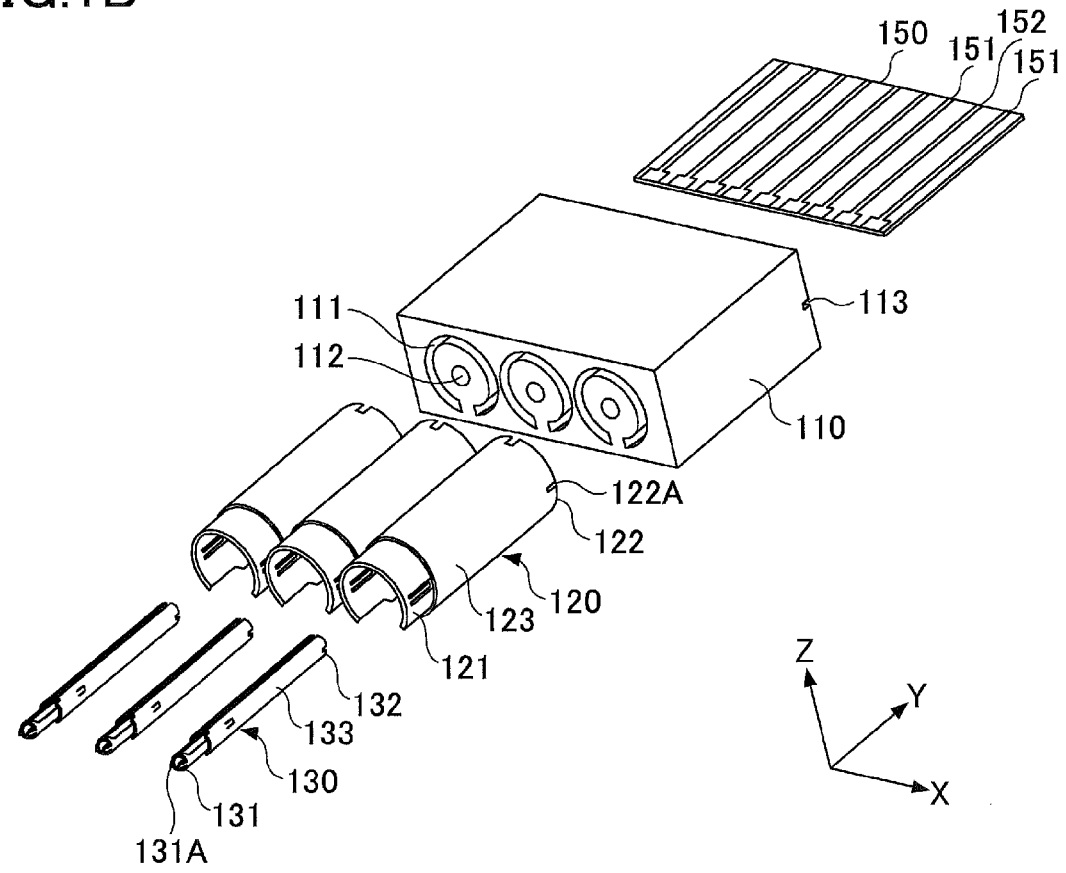
Figure 2A:
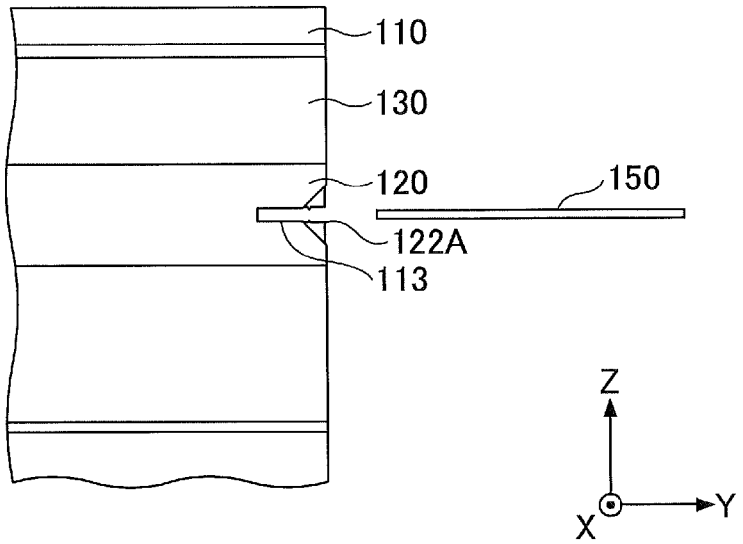
FIGS. 2A and 2B are enlarged views of part of the connector according to the first embodiment.
Figure 2B:
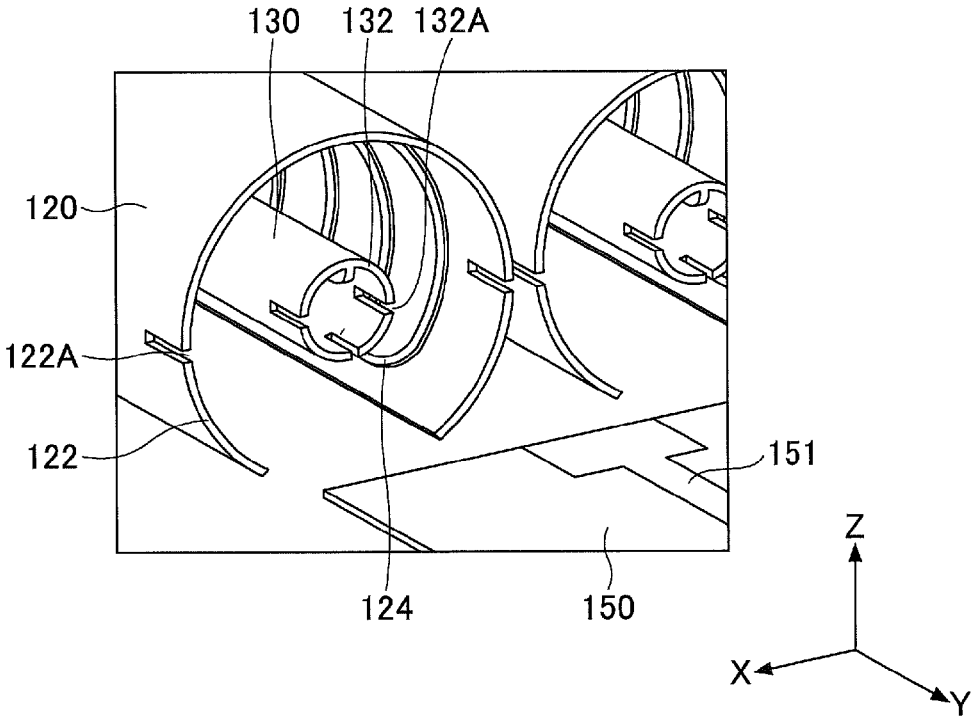

FIGS. 1A and 1B are a perspective view and an exploded perspective view, respectively, of a connector 100 according to a first embodiment. FIGS. 2A and 2B are enlarged views of part of the connector 100. In FIGS. 1A through 2B, an XYZ coordinate system, which is a Cartesian coordinate system, is defined as illustrated, where the positive half (side) of each of the X-axis, Y-axis, and Z-axis is indicated by an arrow. Hereinafter, the direction of each axis, that is, the direction from the negative side to the positive side of each axis, is referred to as "positive axis direction", and the direction opposite to the positive axis direction is referred to as "negative axis direction."

The connector 100 includes housings 110, ground pins 120, and signal pins 130. FIGS. 1A and 1B also illustrate boards 150 connected to the connector 100. The boards 150 are, for example, FR4 (Flame Retardant type 4) boards, and include an insulating layer formed of a glass epoxy resin, ground lines 151, and signal lines 152. Hereinafter, the housings 110 may be collectively referred to as "housing 110."

The housing 110 is formed of an insulating material such as an epoxy resin. Referring to FIG. 1B, holes 111 and 112 are formed through the housing 110 in the positive Y-axis direction. Furthermore, cuts 113 are formed in the housing 110 so as to extend from an end of the housing 110 in the negative Y-axis direction.

The ground pins 120 and the signal pins 130 are inserted into the holes 111 and 112, respectively, so as to be attached to the housing 110 as illustrated in FIG. 1A. The boards 150 are inserted into the cuts 113 of the housing 110, so that the ground lines 151 formed on the boards 150 are connected to the ground pins 120 and the signal lines 152 formed on the boards 150 are connected to the signal pins 130. The ground lines 151 are provided in pairs with one ground line 151 on each side of each signal line 152 and extend parallel to the signal lines 152, so as to form a coplanar waveguide in order to set the characteristic impedance of each signal line 152 to a predetermined value (for example, 50Ω).

The ground pins 120 and the signal pins 130 are insulated from each other when attached to the housing 110 as illustrated in FIG. 1A. The ground pins 120 and the signal pins 130 have respective cylindrical shapes that are different in diameter, and basically have the same configuration. The ground pins 120 and the signal pins 130 are concentrically disposed when viewed in an XZ plane. In the following description, the ground pins 120 may be collectively referred to as "ground pin 120" and the signal pins 130 may be collectively referred to as "signal pin 130." Furthermore, the boards 150 may be collectively referred to as "board 150."

Each of the ground pin 120 and the signal pin 130 is formed of a single metal plate. Each of the ground pin 120 and the signal pin 130 is formed by, for example, blanking a piece having a predetermined shape out of a copper plate and thereafter bending the blanked-out piece.

The ground pin 120 includes a terminal 121, a terminal 122, a cover 123, and a connecting part 124. The ground pin 120 includes elements other than the terminals 121 and 122, the cover 123, and the connecting part 124. The terminals 121 and 122 and the cover 123 are visible in the finished-product state of the ground pin 120 illustrated in FIG. 1B. The connecting part 124 is illustrated in FIG. 2B.

The terminal 121 is positioned at a first end of the ground pin 120 (facing in the negative Y-axis direction). The terminal 121 has a cylindrical shape including a gap that faces in the negative Z-axis direction. A cross section of the terminal 121 parallel to an XZ plane has a C shape. The terminal 121 is connected via the connecting part 124 provided inside the cover 123 to the terminal 122 at a second end of the ground pin 120 opposite to the first end.

The terminal 122 has a cylindrical shape including a gap that faces in the negative Z-axis direction. A cross section of the terminal 122 parallel to an XZ plane has a C shape. The cylindrical shape of the terminal 122 is slightly larger in diameter than the cylindrical shape of the terminal 121.

Furthermore, cuts 122A are formed in the terminal 122 so as to extend from an end of the terminal 122 in the negative Y-axis direction. The corresponding ground lines 151 of the board 150 are connected to the cuts 122A of the terminal 122.

The cover 123 has the shape of the terminal 122 elongated in the negative Y-axis direction. That is, the cover 123 has a cylindrical shape including a gap that faces in the negative Z-axis direction, and a cross section of the cover 123 parallel to an XZ plane has a C shape. The cylindrical shape of the cover 123 is equal in diameter to the cylindrical shape of the terminal 122.

The terminals 121 and 122 are connected by the connecting part 124 (FIG. 23) provided inside the cylinder of the cover 123. The connecting part 124 is elastic so as to be extendable and compressible in directions along the Y-axis. The connecting part 124 has a shape similar to the shape of a meandering member, extending through a series of turns in the positive (or negative) Y-axis direction, bent into a cylindrical shape along an internal circumferential surface of the cover 123.

When the connecting part 124 is compressed, the terminal 121 moves in the positive Y-axis direction from the position illustrated in FIG. 1B relative to the terminal 122. That is, the terminal 121 is telescopically movable into the cover 123.

When the ground pin 120 of the above-described configuration is attached to the housing 110 as illustrated in FIG. 1A, the terminal 121 projects in the negative Y-axis direction from a surface 110A of the housing 110. Furthermore, the cover 123 is inside the corresponding hole 111 of the housing 110 so that an end of the cover 123 facing in the negative Y-axis direction is positioned in the same plane as the surface 110A. That is, when the ground pin 120 is attached to the corresponding hole 111 of the housing 110, a portion of the terminal 121 extending in the negative Y-axis direction from the cover 123 illustrated in FIG. 1B extends from the surface 110A of the housing 110. The configuration of the ground pin 120 is described in more detail below.

The signal pin 130 includes a terminal 131, a terminal 132, a cover 133, and a connecting part 134 (described below with reference to FIGS. 3A through 9C). Each signal pin 130 has a cylindrical shape smaller in diameter than the cylindrical shape of the ground pin 120. The signal pin 130 has the same configuration as the ground pin 120 except for the detailed configurations of the terminals 131 and 132. The connecting part 134 of the signal pin 130, which has the same configuration as the connecting part 124 of the ground pin 120, is not illustrated in FIGS. 1A through 23.

The terminal 131 is positioned at a first end of the signal pin 130 (facing in the negative Y-axis direction), and has a cylindrical shape. The terminal 131 has the shape of a single metal plate rolled into a cylindrical shape around a central axis parallel to the Y-axis. Therefore, the terminal 131 has a substantially circular shape although, technically speaking, the circumference is discontinuous, when viewed in an XZ plane. The terminal 131 is connected to the terminal 132 positioned at a second end of the signal pin 130 opposite to the first end via the connecting part 134 provided inside the cover 133. Furthermore, the terminal 131 includes a pair of projections 131A that project in the negative Y-axis direction. The terminal 131, however, does not have to include the projections 131A. In this case, an end of the terminal 131 facing in the negative Y-axis direction is flat along an XZ plane.

The terminal 132 has a cylindrical shape. The terminal 132 has the shape of a single metal plate rolled into a cylindrical shape around a central axis parallel to the Y-axis. Therefore, the terminal 132 has a substantially circular shape although, technically speaking, the circumference is discontinuous, when viewed in an XZ plane. The cylindrical shape of the terminal 132 is slightly larger in diameter than the cylindrical shape of the terminal 131.

Furthermore, cuts 132A are formed in the terminal 132 so as to extend from an end of the terminal 132 in the negative Y-axis direction. The corresponding signal line 152 of the board 150 is connected to the cuts 132A of the terminal 132.

The cover 133 has the shape of the terminal 132 elongated in the negative Y-axis direction. That is, the cover 133 has a cylindrical shape, and a cross section of the cover 133 parallel to an XZ plane has a substantially circular shape. The cylindrical shape of the cover 133 is equal in diameter to the cylindrical shape of the terminal 132.

The terminals 131 and 132 are connected by the connecting part 134 provided inside the cylinder of the cover 133. The connecting part 134 of the signal pin 130, although not illustrated in FIGS. 1A through 2B, has, the same configuration as the connecting part 124 of the ground pin 120.

Therefore, the connecting part 134 of the signal pin 130 is elastic so as to be extendable and compressible in directions along the Y-axis. The connecting part 134 has a shape similar to the shape of a meandering member, extending through a series of turns in the positive (or negative) Y-axis direction, bent into a cylindrical shape along an internal circumferential surface of the cover 133.

When the connecting part 134 of the signal pin 130 is compressed, the terminal 131 moves in the positive Y-axis direction from the position illustrated in FIG. 1B relative to the terminal 132. That is, the terminal 131 is telescopically movable into the cover 133.

When the signal pin 130 of the above-described configuration is attached to the housing 110 as illustrated in FIG. 1A, the terminal 131 projects in the negative Y-axis direction from the surface 110A of the housing 110. Furthermore, the cover 133 is inside the corresponding hole 112 of the housing 110 so that an end of the cover 133 facing in the negative Y-axis direction is positioned in the same plane as the surface 110A. That is, when the signal pin 130 is attached to the corresponding hole 112 of the housing 110, a portion of the terminal 131 extending in the negative Y-axis direction from the cover 133 illustrated in FIG. 1B extends from the surface 110A of the housing 110. The configuration of the signal pin 130 is described in more detail below.

Next, a method of manufacturing the ground pin 120 and the signal pin 130 and more specific configurations of the ground pin 120 and the signal pin 130 are described. As described above, the ground pin 120 and the signal pin 130 are similar in configuration. Accordingly, here, the signal pin 130 is described.

Figure 3A:
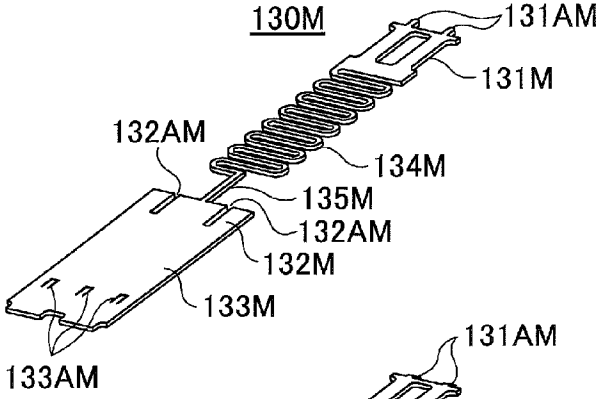
FIGS. 3A through 3F are diagrams illustrating a method of manufacturing a signal pin according to the first embodiment.
Figure 3B:
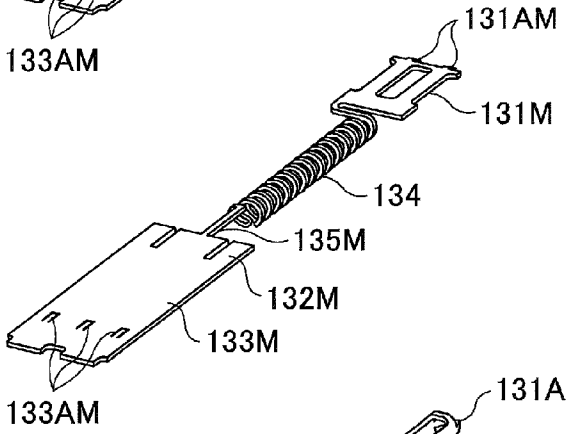
Figure 3C:
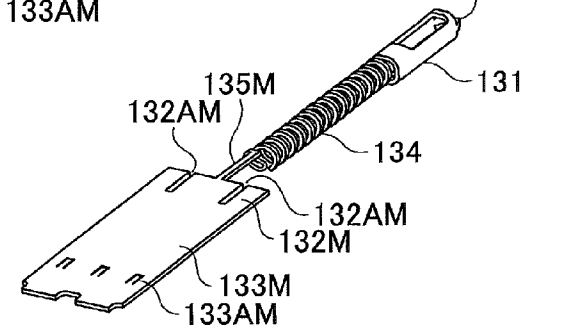
Figure 3D:
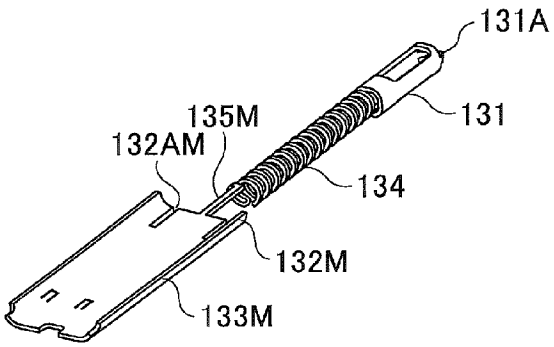
Figure 3E:
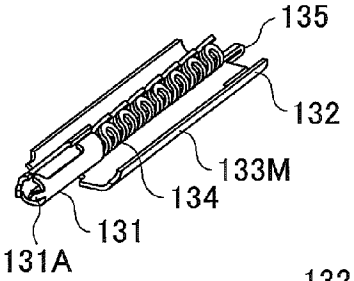
Figure 3F:
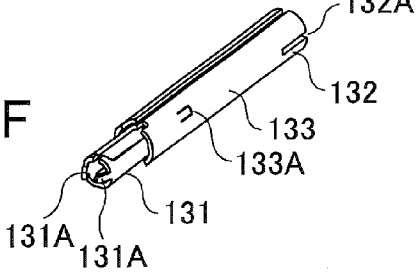

FIGS. 3A through 3F, FIGS. 4A through 4C, FIGS. 5A through 5C, FIGS. 6A through 6C, FIGS. 7A through 7C, FIGS. 8A through 8C, and FIGS. 9A through 9C are diagrams illustrating a method of manufacturing the signal pin 130 according to the first embodiment. FIGS. 3A through 3F are perspective views of the signal pin 130. FIGS. 4A, 5A, 6A, 7A, 8A and 9A are plan views of the signal pin 130. FIGS. 4B, 5B, 6B, 7B, 8B and 9B are side views of the signal pin 130 taken in a longitudinal direction of the signal pin 130. FIGS. 4C, 5C, 6C, 7C, 8C and 9C are side views of the signal pin 130 taken in a direction perpendicular to a longitudinal direction of the signal pin 130. FIG. 3A corresponds to FIGS. 4A through 4C, FIG. 3B corresponds to FIGS. 5A through 5C, FIG. 3C corresponds to FIGS. 6A through 6C, FIG. 3D corresponds to FIGS. 7A through 7C, FIG. 3E corresponds to FIGS. 8A through 8C, and FIG. 3F corresponds to FIGS. 9A through 9C. In the following description, an element in the middle of a manufacturing process is indicated by adding "M" to its reference numeral.

First, as illustrated in FIGS. 3A and 4A through 4C, a metal plate 130M is prepared. The metal plate 130M is blanked out from a single sheet of metal in order to form the signal pin 130 (FIG. 1B). The metal plate 130M includes a terminal 131M, a terminal 132M, a cover 133M, a connecting part 134M and a connecting part 135M.

The terminal 131M, the terminal 132M, and the cover 133M, which have a flat plate shape, are the terminal 131, the terminal 132, and the cover 133 illustrated in FIG. 1B, respectively, before bending. Furthermore, the connecting parts 134M and 135M connect the terminals 131M and 132M. The connecting part 134M has a meandering shape in a plan view. The connecting part 135M has a linear shape.

The terminal part 131M is provided with a pair of projections 131AM. The terminal 132M is an end portion of the cover 133M. Cuts 132AM are formed in the terminal 132M. Three projections 133AM are formed on the cover 133.

Next, the connecting part 134M is bent into a cylindrical shape so as to form the connecting part 134, and the projections 131AM are bent, as illustrated in FIGS. 3B and 5A through 5C. The connecting part 134M may be bent using a mold having a curvature corresponding to the outside diameter of the connecting part 134, for example. As described above, the connecting part 134 is formed by bending a member having a meandering shape in a plan view (FIG. 4A) into a cylindrical shape whose central axis is parallel to directions in which the member having a meandering shape extends through a series of turns. Therefore, the connecting part 134 has such spring elasticity as to be extendable and compressible in the directions in which the member having a meandering shape extends through a series of turns.

Next, the terminal 131M is bent into a cylindrical shape so as to form the terminal 131 as illustrated in FIGS. 3C and 6A through 6C. The terminal 131M may be bent using a mold having a curvature corresponding to the outside diameter of the terminal 131, for example.

Next, both longitudinal side edges of the cover 133M are slightly bent toward each other as illustrated in FIGS. 3D and 7A through 7C. This bending of the cover 133M may be performed using a mold having a suitable shape.

Next, the connecting part 135M is bent in the middle in its longitudinal direction so as to be folded back, so that the terminal 131 and the connecting part 134, and the cover 133M are on top of each other as illustrated in FIGS. 3E and 8A through 8C. At this point, the terminal 131 and the connecting part 134, and the cover 133M are kept at a predetermined distance from each other so as to be out of contact with each other. In order to thus keep the terminal 131 and the connecting part 134, and the cover 133M out of contact with each other, the radius of curvature at the time of bending the cover 133M may be determined to be greater than the radius of curvature of the cylindrical shape of each of the terminal 131 and the connecting part 134. As a result of the above-described process, the connecting part 135M becomes a connecting part 135.

Finally, the longitudinal side edges of the cover 133M are further bent toward each other, so that the cover 133M is bent into a cylindrical shape. As a result, the cover 133 is concentrically provided around the terminal 132 and the connecting part 134 as illustrated in FIGS. 3F and 9A through 9C.

According to the signal pin 130 thus manufactured, the terminal 131 is telescopically movable relative to the cover 133 because of the spring elasticity of the connecting part 134. Projections 133A are provided on the cover 133 so as to engage the signal pin 130 with an inner wall of the corresponding hole 112 of the housing 110 when the signal pin 130 is inserted into the corresponding hole 112.

While the manufacturing process of the signal pin 130 is described above, the ground pin 120 may also be manufactured from a single metal plate in the same manner. That is, the terminal 131, the terminal 132, the cover 133, and the connecting part 134 of the signal pin 130 correspond to the terminal 121, the terminal 122, the cover 133, and the connecting part 124, respectively, of the ground pin 120. The ground pin 120 includes a linear connecting part corresponding to the connecting part 135 of the signal pin 130, and the terminal 121 and the cover 123 are connected by this linear connecting part. Accordingly, the terminal 121 of the ground pin 120 is telescopically movable relative to the cover 123 because of the spring elasticity of the connecting part 124.

Next, a board 300 to which the terminals 121 and 131 of the connector 100 according to the first embodiment are connected is described.

Figure 10:
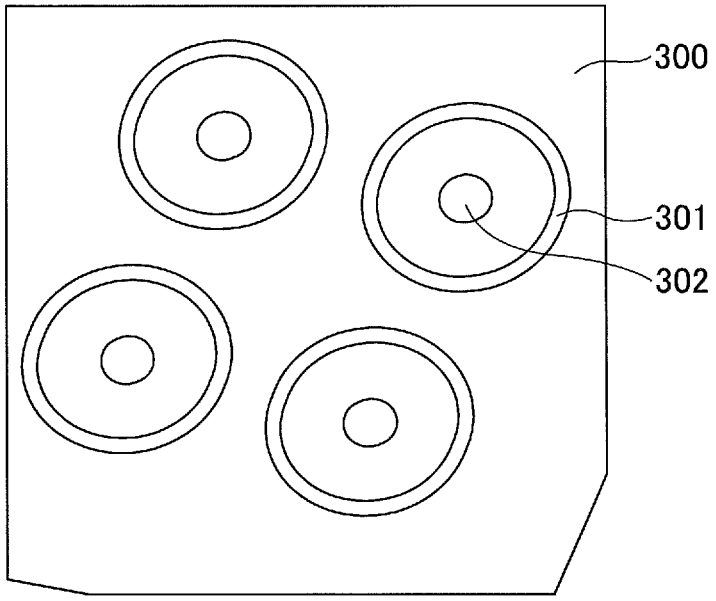
FIG. 10 is a diagram illustrating a surface of a board to which terminals of the connector according to the first embodiment are connected.

FIG. 10 is a diagram illustrating a surface of the board 300. Annular electrically conductive parts 301 and circular electrically conductive parts 302 are formed on a surface of the board 300. Hereinafter, the electrically conductive parts 301 and the electrically conductive parts 302 may be collectively referred to as "electrically conductive part 301" and "electrically conductive part 302," respectively. The electrically conductive part 302 is positioned at the center of the electrically conductive part 301 in a plan view. The electrically conductive parts 301 and 302 are connected to a ground line and a signal line, respectively, of the board 300. The electrically conductive parts 301 and 302 are concentrically provided.

The diameter and the width of the annular shape of the electrically conductive part 301 are set to values corresponding to the diameter and the thickness of an end of the cylindrical terminal 121 of the connector 100. The diameter of the electrically conductive part 302 is set to a value corresponding to the diameter of an end of the cylindrical terminal 131 of the connector 100.

By connecting the terminals 121 and 131 to the electrically conductive parts 301 and 302, respectively, it is possible to connect the ground pin 120 and the signal pin 130 to a ground line and a signal line, respectively, of the board 300.

For example, by connecting the terminals 121 and 131 to the electrically conductive parts 301 and 302, respectively, by soldering or the like, and fixing the connector 100 to the board 300 using a jig while pressing the connector 100 against the board 300, the terminals 121 and 131 are covered with the concentrically provided covers 123 and 133, respectively.

Therefore, it is possible to connect the terminals 121 and 131 and the electrically conductive parts 301 and 302 with impedance matching. In particular, the terminal 121 of the ground pin 120 is cylindrical in a plan view and the terminal 131 is positioned inside the cylinder of the terminal 121, and the electrically conductive part 301 is annular and the electrically conductive part 302 is concentrically provided inside the circle of the electrically conductive part 301 in a plan view. Therefore, it is possible to achieve desirable impedance matching at the connection of the terminals 121 and 131 and the electrically conductive parts 301 and 302.

Furthermore, each signal line 152 of the board 150 (illustrated in FIGS. 1A and 1B) forms a coplanar waveguide with impedance matching with the ground lines 151 provided one on each side of the signal line 152 so as to extend parallel to the signal line 152. The board 150 is inserted into the cuts 122A and 132A, so that the ground lines 151 and the signal line 152 are connected to the terminals 122 and 132, respectively.

Accordingly, it is possible to connect the terminals 122 and 132 of the connector 100 and the ground lines 151 and the signal line 152 of the board 150 with impedance matching.

Thus, according to the connector 100 of the first embodiment, it is possible to connect the connector 100 and the board 150 with impedance matching and to connect the connector 100 and the board 300 with impedance matching.

Therefore, according to the first embodiment, it is possible to provide the connector 100 capable of transmitting a signal with impedance matching.

In the configuration described above, an end of the cover 123 is positioned in the same plane as the surface 110A of the housing 110. Alternatively, an end of the cover 123 may project from the surface 110A of the housing 110. In this case, the terminal 121 may project from the cover 123.

Second Embodiment

Figure 11A:
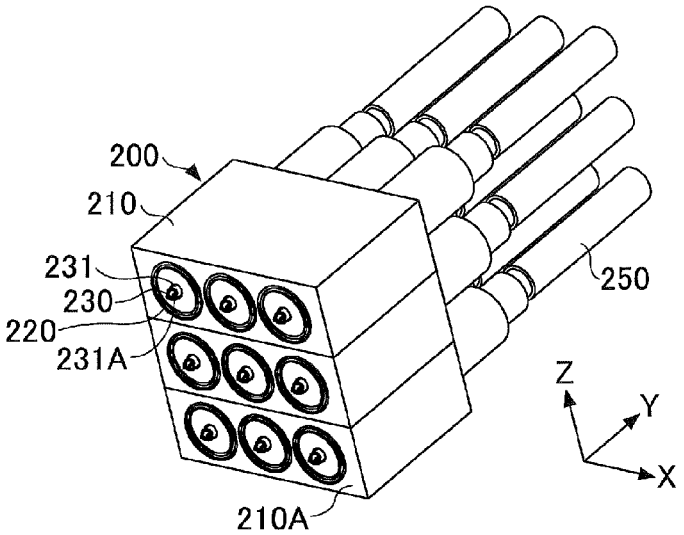
FIGS. 11A and 11B are diagrams illustrating a connector according to a second embodiment.
Figure 11B:
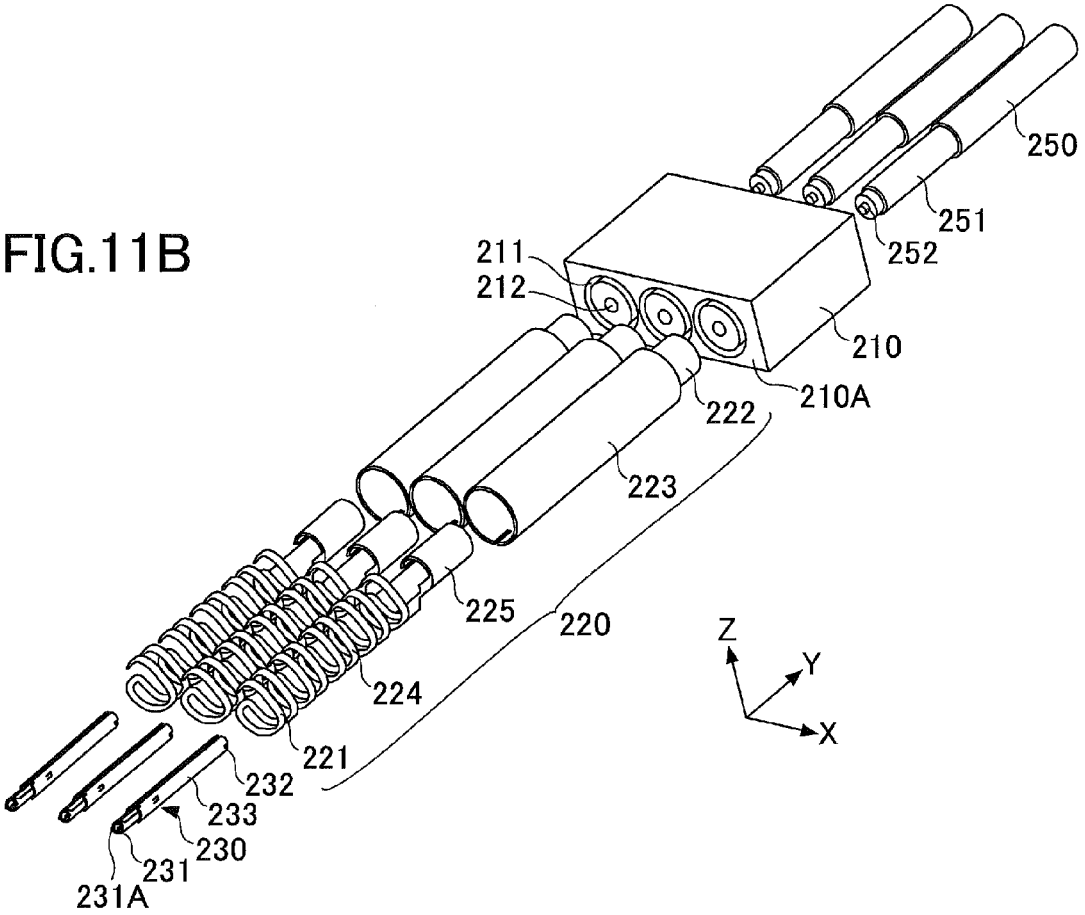

FIGS. 11A and 11B are diagrams illustrating a connector 200 according to a second embodiment. According to the connector 200, the cover 123 and the terminal 122 of the ground pin 120 of the first embodiment are manufactured from a metal plate different from that of the terminal 121 of the connecting part 124 of the ground pin 120, and the connecting part 124 and the terminal 122 are joined. The signal pin 130 of the first embodiment does not include the cuts 132A.

The connector 200 includes housings 210 (hereinafter collectively referred to as "housing 210"), ground pins 220 (hereinafter collectively referred to as "ground pin 220"), and signal pins 230 (hereinafter collectively referred to as "signal pin 230"). FIGS. 11A and 11B also illustrate coaxial cables 250 (hereinafter collectively referred to as "cable 250") that connect to the connector 200.

The housing 210 is the same as the housing 110 of the first embodiment. Referring to FIG. 11B, holes 211 and 212 are formed through the housing 210 in the positive Y-axis direction.

The ground pin 220 and the signal pin 230 are inserted into the corresponding holes 211 and 212, respectively, so that the ground pin 220 and the signal pin 230 are attached to the housing 210 as illustrated in FIG. 11A.

The ground pin 220 and the signal pin 230 are insulated from each other when attached to the housing 210 as illustrated in FIG. 11A. The ground pin 220 and the signal pin 230 have respective cylindrical shapes that are different in diameter, and basically have the same configuration. The ground pin 220 and the signal pin 230 are concentrically disposed when viewed in an XZ plane.

Figure 12:
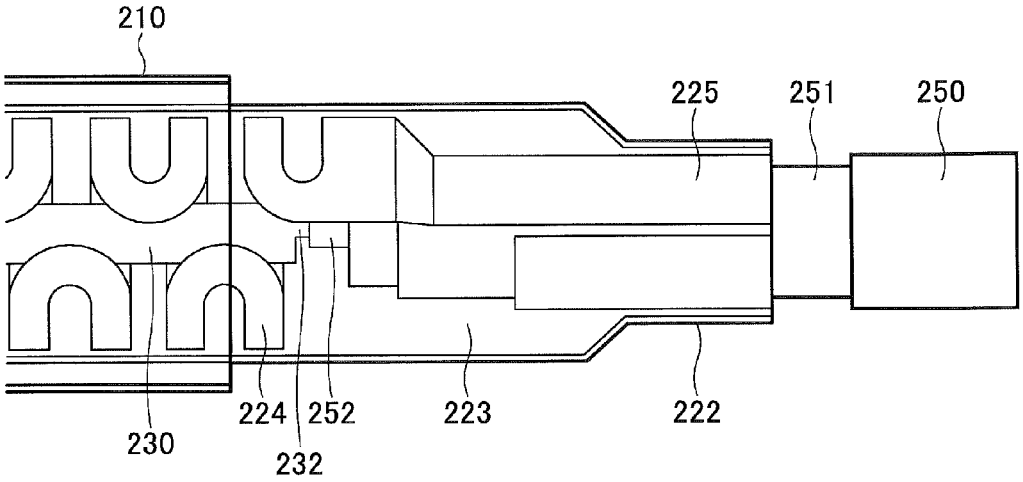
FIG. 12 is a schematic diagram illustrating a ground pin and a signal pin of the connector according to the second embodiment.

The ground pin 220 includes a terminal 221, a terminal 222, a cover 223, a connecting part 224, and a connecting part 225. FIG. 12 is a schematic diagram illustrating the ground pin 220 and the signal pin 230 of the connector 200 according to the second embodiment. In FIG. 12, the inside of the ground pin 220 is illustrated in a see-through manner. The terminal 221, the connecting part 224, and the connecting part 225 are formed of a single metal plate, and the terminal 222 and the cover 223 are formed of another single metal plate. That is, the ground pin 220 is formed of two metal plates.

The terminal 221 is positioned at one end of the connecting part 224 (facing in the negative Y-axis direction). Like the connecting part 124 of the ground pin 120 of the first embodiment, the connecting part 224 is a member having spring elasticity.

The terminal 222 is positioned at one end of the cylindrical cover 223 (facing in the positive Y-axis direction). Like the cover 223, the terminal 222 has a cylindrical shape. The terminal 222 is smaller in diameter than the cover 223. The connecting part 225 is fitted into the terminal 222. A shield line 251 of the coaxial cable 250 is fitted into the connecting part 225. The diameter of the cylindrical shape of the connecting part 225 is set to a value substantially equal to the outside diameter of the shield line 251 of the coaxial cable 250, so that the shield line 251 may be fitted into the connecting part 225.

The cover 223 has the shape of the terminal 222 elongated in the negative Y-axis direction. The diameter of the cover 223, however, is greater than the diameter of the cylindrical shape of the terminal 222.

The terminals 221 and 222 are connected by the connecting parts 224 and 225 provided inside the cylinder of the cover 223. The connecting part 224 is elastic so as to be extendable and compressible in directions along the Y-axis. The connecting part 224 has a shape similar to the shape of a meandering member, extending through a series of turns in the positive (or negative) Y-axis direction, bent into a cylindrical shape along an internal circumferential surface of the cover 223. The terminal 221 is an end portion of the connecting part 224 facing in the negative Y-axis direction. Therefore, the terminal 221 is circular when viewed in an XZ plane.

The connecting part 225 extends from an end of the connecting part 224 in the positive Y-axis direction. The connecting part 225 is a cylindrical member having an outside diameter equal to the inside diameter of the terminal 222. The connecting part 225 is fitted into the terminal 222. As a result, the terminal 221, the connecting part 224 and the connecting part 225, and the terminal 222 and the cover 223 are integrated.

When the connecting part 224 is compressed, the terminal 221 moves in the positive Y-axis direction from the position illustrated in FIG. 11B relative to the connecting part 225. That is, the terminal 221 is telescopically movable into the cover 223.

The terminal 221, the connecting part 224, and the connecting part 225 may be manufactured from a single metal plate in the same manner as the ground pin 120 of the first embodiment excluding the cover part 123 and the terminal 122. Furthermore, the terminal 222 and the cover 223 may be manufactured from another single metal plate.

When the ground pin 220 of the above-described configuration is attached to the housing 210 as illustrated in FIG. 11A, the terminal 221 projects in the negative Y-axis direction from a surface 210A of the housing 210. Furthermore, the cover 223 is inside the corresponding hole 211 of the housing 210 so that an end of the cover 223 facing in the negative Y-axis direction is positioned in the same plane as the surface 210A. That is, when the ground pin 220 is attached to the corresponding hole 211 of the housing 210, a portion of the terminal 221 extending in the negative Y-axis direction from the cover 223 illustrated in FIG. 11B extends from the surface 210A of the housing 210. The configuration of the ground pin 220 is described in more detail below.

The cylindrical shape of the signal pin 230 is smaller in diameter than the cylindrical shape of the ground pin 220. The signal pin 230 has the same configuration as the signal pin 130 of the first embodiment except that the signal pin 230 does not include the cuts 132A. The signal pin 230 includes a terminal 231, a terminal 232, a cover 233, and a connecting part having the same configuration as the connecting part 134 of the first embodiment. The terminal 231 includes a pair of projections 231A that project in the negative Y-axis direction. The terminal 231, however, does not have to include the projections 231A. In this case, an end of the terminal 231 facing in the negative Y-axis direction is flat along an XZ plane. A core 252 of the coaxial cable 250 connects to the terminal 232.

When the signal pin 230 is attached to the housing 210 as illustrated in FIG. 11A, the terminal 231 projects in the negative Y-axis direction from the surface 210A of the housing 210. Furthermore, the cover 233 is inside the corresponding hole 212 of the housing 210 so that an end of the cover 233 facing in the negative Y-axis direction is positioned in the same plane as the surface 210A. That is, when the signal pin 230 is attached to the corresponding hole 212 of the housing 210, a portion of the terminal 231 extending in the negative Y-axis direction from the cover 233 illustrated in FIG. 11B extends from the surface 210A of the housing 210.

The terminal 221 of the ground pin 220 of the connector 200 according to the second embodiment is connected to the electrically conductive part 301 of the board 300 illustrated in FIG. 10. The terminal 221 is equal in diameter to the electrically conductive part 301. Therefore, it is possible to connect the terminal 221, which is circular when viewed in an XZ plane, to the annular electrically conductive part 301. Furthermore, it is possible to connect the terminal 231 of the signal pin 230 to the electrically conductive part 302 of the board 300 in the same manner as the signal pin 130 of the connector 100 of the first embodiment.

Therefore, it is possible to connect the connector 200 to the board 300 with impedance matching on the side facing in the negative Y-axis direction.

Furthermore, on the side of the connector 200 facing in the positive Y-axis direction, the shield line 251 of the coaxial cable 250 is fitted into the connecting part 225 of the ground pin 220, and the terminal 232 of the signal pin 230 is connected to the core 252 of the coaxial cable 250.

Therefore, it is possible to connect the connector 200 to the coaxial cable 250 with impedance matching on the side facing in the positive Y-axis direction.

Thus, according to the connector 200 of the second embodiment, it is possible to connect the connector 200 and the coaxial cable 250 with impedance matching and to connect the connector 200 and the board 300 with impedance matching.

Therefore, according to the second embodiment, it is possible to provide the connector 200 capable of transmitting a signal with impedance matching.

In the configuration described above, an end of the cover 223 is positioned in the same plane as the surface 210A of the housing 210. Alternatively, an end of the cover 223 may project from the surface 210A of the housing 210. In this case, the terminal 221 may project from the cover 223.

Furthermore, in the configuration described above, the coaxial cable 250 is connected to the connector 200. Alternatively, the same cuts as the cuts 122A of the terminal 122 of the ground pin 120 of the first embodiment may be formed in the terminal 222, and the same cuts as the cuts 132A of the terminal 132 of the signal pin 130 of the first embodiment may be formed in the connecting part 225, so that the board 150 may be connected to the connector 200 in the same manner as in the first embodiment.

Furthermore, the coaxial cable 250 may be connected to the connector 100 of the first embodiment.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Connectors have been described above based on one or more embodiments of the present invention. It should be understood, however, that various changes, substitutions, and alterations could be made hereto without departing from the spirit and scope of the invention.

What is claimed is:

1. A connector to be connected to a ground line and a signal line formed on a board, the connector comprising:

a housing;

a ground pin provided inside a hole in the housing, the ground pin including a first cylindrical part;

a first cylindrical terminal that has a diameter smaller than a diameter of the first cylindrical part, and is telescopically movable into the first cylindrical part in a direction of a first central axis of the first cylindrical part; and a first elastic member provided inside the first cylindrical part, the first elastic member connecting the first cylindrical terminal and the first cylindrical part and extending in the direction of the first central axis in a meandering and cylindrical manner along an internal surface of the first cylindrical part, the first elastic member being compressible in the direction of the first central axis; and a signal pin formed of a one-piece metal plate, and is held in the housing, the signal pin including a second cylindrical part;

a second cylindrical terminal that has a diameter smaller than a diameter of the second cylindrical part, and is telescopically movable into the second cylindrical part in a direction of a second central axis of the second cylindrical part; and a second elastic member provided inside the second cylindrical part, the second elastic member connecting the second cylindrical terminal and the second cylindrical part and extending in the direction of the second central axis in a meandering and cylindrical manner along an internal surface of the second cylindrical part, the second elastic member being compressible in the direction of the second central axis, wherein the signal pin is provided concentrically with the first elastic member and the first cylindrical part, the first cylindrical terminal and the second cylindrical terminal extend outward from an end of the housing, and the first cylindrical part and the second cylindrical part are connected to the ground line and the signal line, respectively, with the first cylindrical terminal and the second cylindrical terminal being in contact with the board and compressed in the direction of the first central axis and the direction of the second central axis, respectively.

2. The connector as claimed in claim 1, wherein the ground pin is formed of a one-piece metal plate different from the metal plate forming the signal pin.

3. The connector as claimed in claim 1, wherein the first cylindrical part is formed of a first metal plate, and the first elastic member and the first cylindrical terminal are formed of a second metal plate.

4. The connector as claimed in claim 1, wherein an end of the first cylindrical part connects to a ground line of a coaxial cable, and an end of the second cylindrical part connects to a core of the coaxial cable.

5. The connector as claimed in claim 1, wherein a first cut is formed in the first cylindrical part so as to extend from an end thereof in a direction opposite to the direction of the first central axis, and a second cut is formed in the second cylindrical part so as to extend from an end thereof in a direction opposite to the direction of the second central axis, and wherein, with an additional board being inserted into the first cut and the second cut, a ground line and a signal line formed at an end of the additional board are connected to the first cylindrical part and the second cylindrical part, respectively.

* * * * *